US007641074B2

(12) United States Patent
Edwards et al.

(10) Patent No.: US 7,641,074 B2
(45) Date of Patent: Jan. 5, 2010

(54) MULTIPLE FLOW CIRCUITS FOR A PRODUCT DISPENSER

(75) Inventors: William A. Edwards, Selma, TX (US); Randeep S. Grewal, San Antonio, TX (US)

(73) Assignee: Lancer Partnership, Ltd., San Antonio, TX (US)

( * ) Notice: Subject to any disclaimer, the term of this patent is extended or adjusted under 35 U.S.C. 154(b) by 625 days.

(21) Appl. No.: 11/227,791

(22) Filed: Sep. 15, 2005

(65) Prior Publication Data

US 2007/0056988 A1 Mar. 15, 2007

(51) Int. Cl.
*B67D 5/56* (2006.01)

(52) U.S. Cl. ..... 222/130; 222/129.1; 222/132; 222/144.5; 137/15.09; 137/884

(58) Field of Classification Search ... 222/129.1–129.4, 222/130, 132, 144.5, 74; 137/15.01, 15.08, 137/15.09, 15.16, 884
See application file for complete search history.

(56) References Cited

U.S. PATENT DOCUMENTS 5,954,235 A * 9/1999 Schroeder et al. ..... 222/129.1
6,698,621 B2 * 3/2004 Landers et al. ..... 222/129.1
2004/0245288 A1 * 12/2004 Tobler ..... 222/129.1
2005/0230421 A1 * 10/2005 Morrow et al. ..... 222/132
2006/0027598 A1 * 2/2006 Ubidia et al. ..... 222/129.1
2006/0071015 A1 * 4/2006 Jablonski et al. ..... 222/1

* cited by examiner

*Primary Examiner*—J. Casimer Jacyna
(74) *Attorney, Agent, or Firm*—Christopher L. Makay

(57) ABSTRACT

A flow circuit connector provides the capability to change the flow paths of a product valve in a beverage dispenser. The flow circuit connector includes a first member that connects two unconnected flow paths, and a second member that stops the flow of fluid within the flow paths not being utilized. In a first embodiment, the flow circuit connector allows an operator to select between two diluent flow paths representing either a chilled diluent or a chilled and carbonated diluent. Configuration may be accomplished on location, and is not a permanent rerouting. In a second embodiment, the beverage dispenser further includes an ambient flow circuit and additional flow circuit connector components as required to complete or cap any exposed flow circuits. In a third embodiment, the beverage dispenser includes at least two product flow circuits representing the delivery of ambient product or a conditioned product.

24 Claims, 11 Drawing Sheets

MULTIPLE FLOW CIRCUITS FOR A PRODUCT DISPENSER

BACKGROUND OF THE INVENTION

1. Field of the Invention

The present invention relates to beverage dispensing and, more particularly, but not by way of limitation, to methods and an apparatus for redirecting diluent flow paths in a beverage dispenser such that a product valve may deliver either a carbonated beverage or a non-carbonated beverage.

2. Description of the Related Art

Historically, the beverage dispensing industry revolved around the reconstitution of syrup concentrates with carbonated water. Consumers often were offered a multitude of soda flavors with a single non-carbonated option in a beverage dispenser. With changing philosophies in the areas of health and nutrition, product dispensing suppliers have been forced to offer a wider variety of products through basically the same interface, a beverage dispenser. Presently, it is common to see beverage dispensers delivering multiple non-carbonated beverages, such as lemonades, teas, sports drinks, and the like.

This changing trend has caused some challenges, as the life expectancy of a beverage dispenser is approximately seven to ten years. Many times older dispensers are not outfitted with product and diluent lines for every possible product valve combination. While newer beverage dispenser designs do take into consideration the possibility of switching between diluents, switching across two media paths provides the possibility of a leak across the switching mechanism, and a compromised mixture upon dispensing.

Similar considerations arise when switching from a chilled product to an ambient product, or the opposite. When utilizing a cold plate to chill product lines in a beverage dispenser, manufacturers are forced to commit fluid media flow paths to being either chilled or unchilled. Most product lines are cast into a cold plate such that they chill the medium flowing through the product lines when the cold plate is chilled. The delivery of an ambient product does not require the fluid medium path to pass through the cold plate. If a beverage dispenser does not have provisions for ambient delivery of product, the fluid path must be altered to circumvent passing through the cold plate.

Accordingly, an apparatus that allows customers to reconfigure the product valves of a beverage dispenser to deliver either chilled or ambient products on location would be beneficial to beverage dispenser manufacturers, beverage dispenser owners, as well as the producers of the beverage drinks.

SUMMARY OF THE INVENTION

In accordance with the present invention, a flow circuit connector provides the capability to change the flow paths of a product valve in a beverage dispenser. The beverage dispenser may include a manifold for alignment and ease of access. The flow circuit connector includes a first member that connects two unconnected flow paths, and a second member that stops the flow of fluid within the flow paths not being utilized. In a first embodiment, the flow circuit connector allows an operator to select between two diluent flow circuits representing either a chilled diluent or a chilled and carbonated diluent. Configuration may be accomplished on location, and is not a permanent rerouting.

In a second embodiment, the beverage dispenser includes a third diluent flow circuit to deliver an ambient diluent, and an additional second member of the flow circuit connector to cap the additional exposed flow circuit.

In a third embodiment, the beverage dispenser includes a first and a second product circuit, and an additional flow circuit connector. The third embodiment provides for switching between ambient and chilled product flow circuits.

It is therefore an object of the present invention to provide an apparatus that allows configuration of a product valve in a beverage dispenser on location.

It is a further object of the present invention to provide a beverage dispenser including a flow circuit connector, whereby the product valves of the beverage dispenser are configurable on location.

It is still further an object of the present invention to provide a beverage dispenser with the ability to switch between multiple diluent flow circuits.

It is still yet further an object of the present invention to provide a beverage dispenser with the ability to switch between multiple product flow circuits.

Still other objects, features, and advantages of the present invention will become evident to those of ordinary skill in the art in light of the following. Also, it should be understood that the scope of this invention is intended to be broad, and any combination of any subset of the features, elements, or steps described herein is part of the intended scope of the invention.

DETAILED DESCRIPTION OF THE PREFERRED EMBODIMENT

Figure 1A:
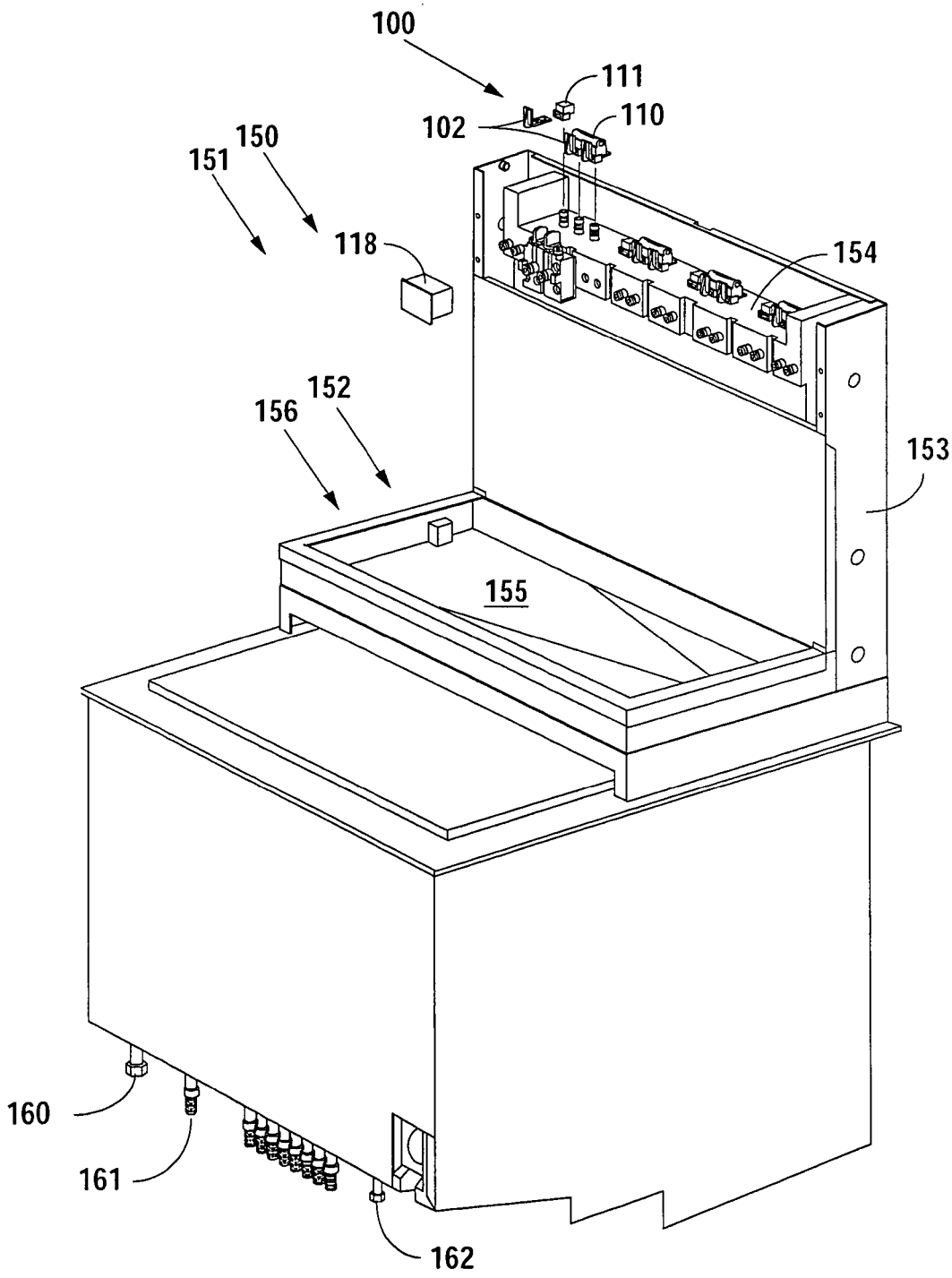
FIG. 1*a* provides a perspective view of a flow circuit connector installed in a beverage dispenser according to a first embodiment.
Figure 1B:
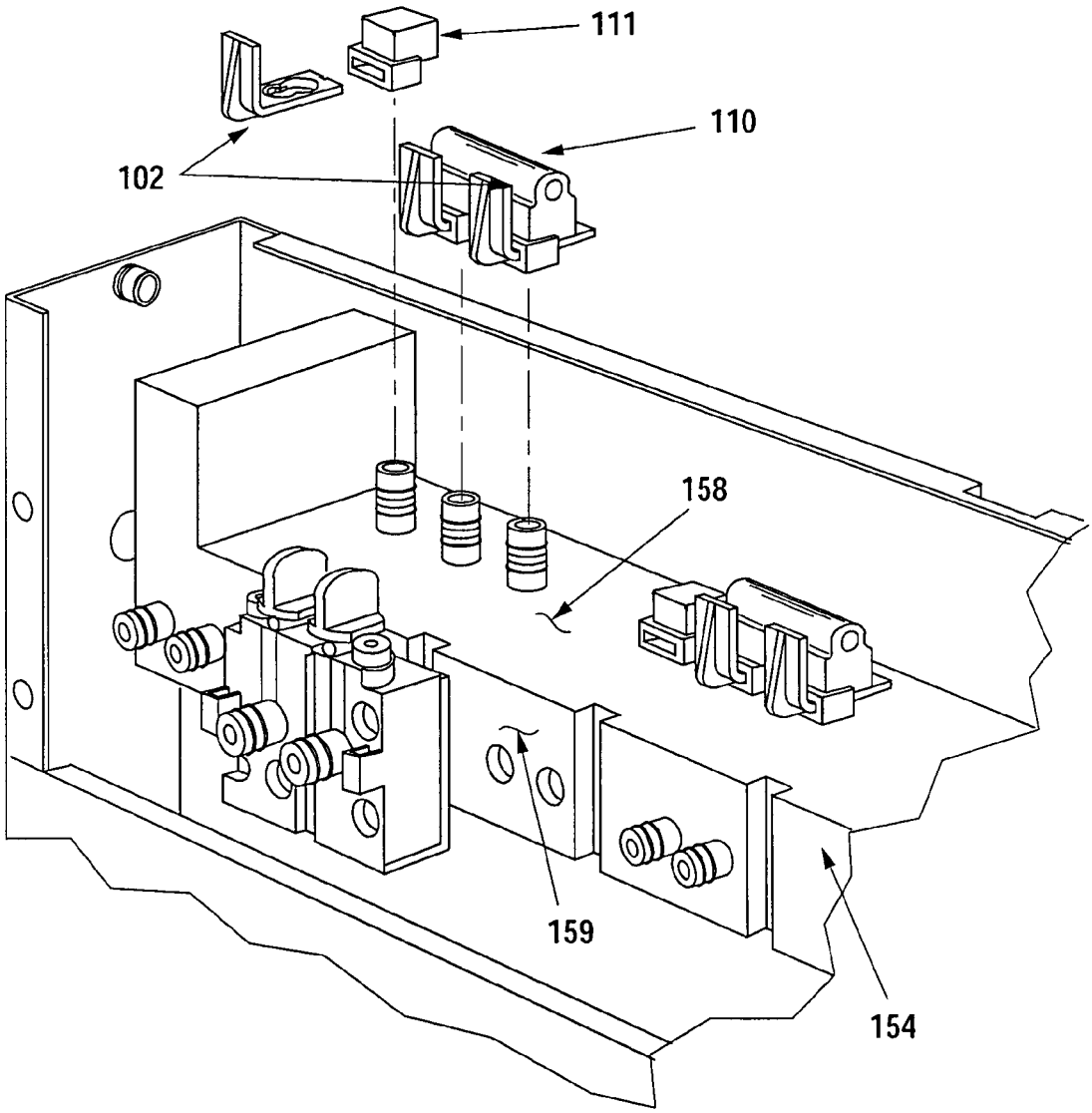
FIG. 1*b* provides a detail view of an upper end of the beverage dispenser according to the first embodiment.

As required, detailed embodiments of the present invention are disclosed herein; however, it is to be understood that the disclosed embodiments are merely exemplary of the invention, which may be embodied in various forms. It is further to be understood that the figures are not necessarily to scale, and some features may be exaggerated to show details of particular components or steps.

A flow circuit connector provides beverage dispenser manufacturers with the ability to reconfigure beverage dispenser product valves in the field. The flow circuit connector allows the product valve to deliver either carbonated beverages or non-carbonated beverages. The flow circuit connector further provides the ability to deliver either ambient beverages or chilled beverages. A first member joins a diluent line of choice with a diluent feed line at the product valve. A second member stops the flow of the undesired diluent. The first and second members may further be utilized to switch from a chilled product to an ambient product. The first member and the second member are removable, however they may be restrained to prevent inadvertent removal.

As shown in FIGS. 1-5, a beverage dispenser 150 includes a housing 151 and a tower 153. The housing 151 may include an ice bin 152 having an access port 156. The ice bin 152 is typically disposed above a cold plate 115, such that ice from the ice bin 152 is directed onto the cold plate 115 to provide cooling to the cold plate 115. The beverage dispenser 150 may further include a lid 155 to insulate and protect the ice stored in the ice bin 152. The tower 153 is disposed atop the housing 151, and includes a manifold 154. The manifold 154 is located at an upper end of the tower 153, and includes at least a first face 158 and a second face 159. The tower 153 is elevated to provide a raised attachment point for product dispensing valves 118 and associated hardware.

The beverage dispenser 150 typically includes multiple product dispensing valves 118, such that multiple products may be offered for consumption, including multiple flavors of sodas, juices, teas, chilled carbonated water, chilled plain water, and mixtures thereof. While most beverage dispensers 150 utilize multiple product dispensing valves 118, only the flow paths associated with one product dispensing valve 118 will be discussed in this disclosure. One of ordinary skill in the art will recognize that the invention is applicable to multiple product dispensing valves 118 in the beverage dispenser 150.

In this first embodiment, the manifold 154 includes a diluent feed aperture 190, a first diluent aperture 191, and a second diluent aperture 192 disposed on the first face 158, and a diluent delivery aperture 195 and a product delivery aperture 196 disposed on the second face 159. The diluent feed aperture 190 is located a predetermined distance from the first diluent aperture 191 and the second diluent aperture 192. In this first embodiment, the apertures 190, 191, and 192 are collinear, and of a size sufficient to accommodate tubing and tubing fittings. The diluent delivery aperture 195 and the product delivery aperture 196 are also collinear, and of a spacing typical to inlets of the dispensing valve 118.

The beverage dispenser 150 further includes a delivery tube 126 having an inlet 145 and an outlet 146. The inlet 145 of the delivery tube 126 protrudes through the diluent feed aperture 190 of the manifold 154, and the outlet 146 protrudes through the diluent delivery aperture 195 of the second face 159.

Figure 2A:
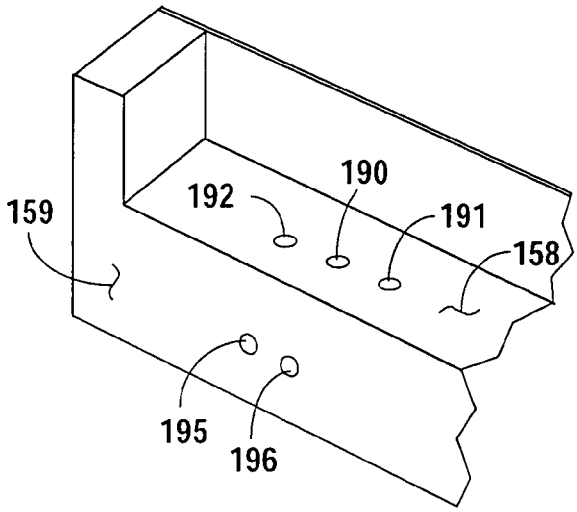
FIG. 2*a* provides a detailed view of a manifold according to the first embodiment.
Figure 2B:
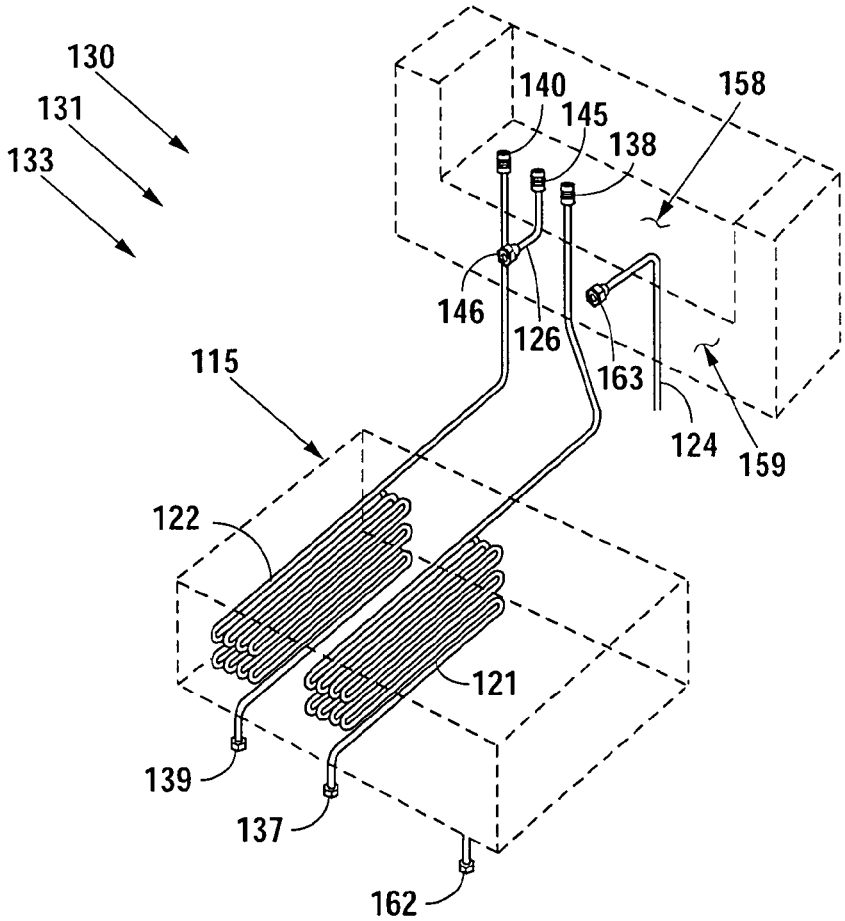
FIG. 2*b* provides a perspective view of a first diluent circuit and a second diluent circuit according to the first embodiment.
Figure 3A:
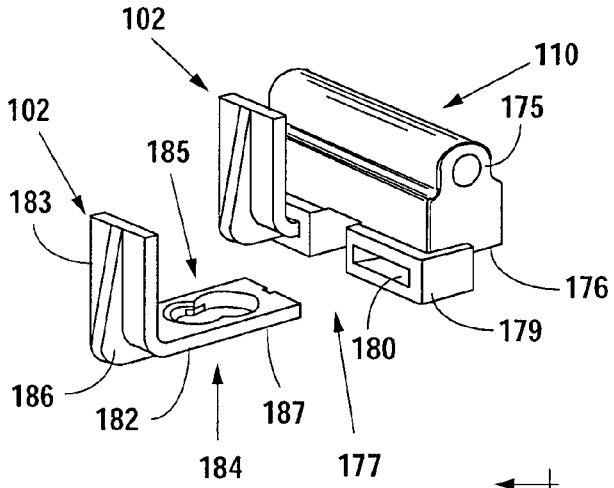
FIG. 3*a* illustrates an exploded view of a first member with securing members according to the first embodiment.
Figure 3B:
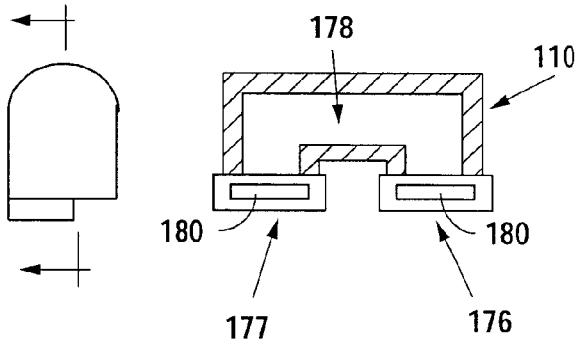
FIG. 3*b* provides a section view of the first member according to the first embodiment.
Figure 4A:
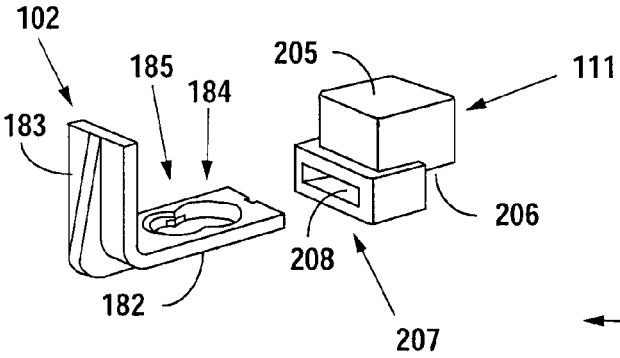
FIG. 4*a* provides an exploded view of a second member with a securing member according to the first embodiment.
Figure 4B:
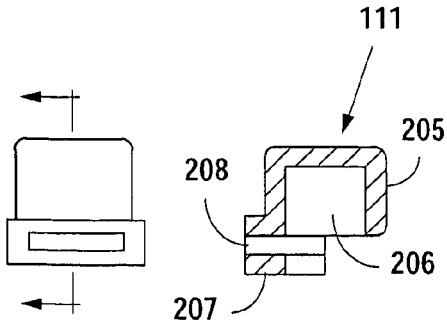
FIG. 4*b* provides a section view of the second member according to the first embodiment.
Figure 5:
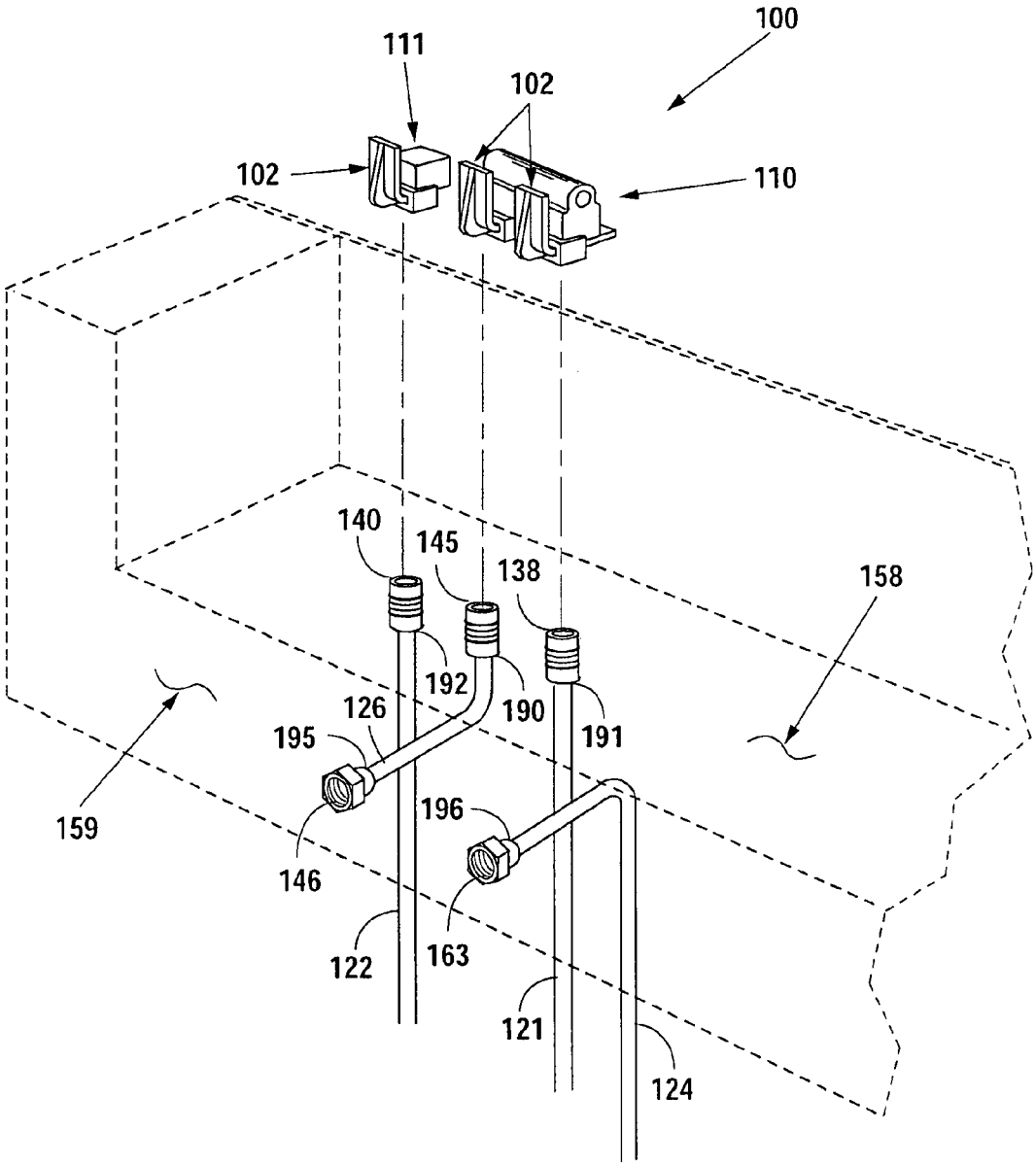
FIG. 5 provides a detail view of a flow circuit connector in position above the first and second diluent flow circuits according to the first embodiment.

As one of ordinary skill in the art will recognize, the beverage dispenser 150 may be adaptable to a water source and at least one product source for each flavor delivered, and may include multiple flow circuits to obtain vary types of products. As shown in FIG. 2*b*, the beverage dispenser 150 of this first embodiment includes a first diluent circuit 130, a second diluent circuit 131, and a product circuit 133. In this first embodiment, the first diluent circuit 130 represents a chilled plain water feed circuit, and the second diluent circuit 131 represents a carbonated and chilled diluent circuit. Further, the product circuit 133 may represent any form of product source, including a chilled syrup concentrate flow path. One of ordinary skill in the art will recognize that other types of flow paths are possible in beverage dispenser designs, such as those for beverages that are consumed at ambient temperatures.

The first diluent circuit 130 includes a first diluent line 121 having an inlet 137 and an outlet 138. In this first embodiment, the first diluent line 121 includes coils disposed within the cold plate 115, and a portion that protrudes from a rear face of the cold plate 115. The first diluent line 121 extends upward through the tower 153 and the outlet 138 passes through the first diluent supply aperture 191 on the first face 158 of the manifold 154. The inlet 137 of the first diluent line 121 may be coupled to any suitable diluent source (not shown).

The second diluent circuit 131 includes a second diluent line 122 having an inlet 139 and an outlet 140. The second diluent line 122 further includes coils that are disposed within the cold plate 115. The inlet 139 of the second diluent line 122 protrudes from the front of the cold plate 115, such that it is accessible by an installer. In this first embodiment, an external carbonator may be utilized to carbonate diluent outside of the housing 151 of the beverage dispenser 150, however, one of ordinary skill in the art will recognize that a carbonator may be integrated into the cold plate 115, and in communication with the second diluent line 122, to carbonate diluent passing through the second diluent line 122. The second diluent line 122 exits a rear face of the cold plate 115, extends upward through the tower 153 and passes through the second diluent supply aperture 192 on the first face 158 of the manifold 154.

In this first embodiment, the product circuit 133 disclosed may be a chilled product circuit. As such, the product circuit 133 may include chilling coils disposed within the cold plate 115. Accordingly, the product circuit 133 includes a product line 124 having an inlet 162 and an outlet 163, wherein coils may be located between the inlet 162 and the outlet 163 and disposed within the cold plate 115. The inlet 162 of the product line 124 protrudes from a front portion of the cold plate 115 for connection to a syrup source. The outlet 163 extends upward through the tower and exits the second face 159 of the manifold 154 through the product delivery aperture 196 for connection to a dispensing valve 118. One of ordinary skill in the art will recognize that the product circuit 133 may be any flow circuit suitable to deliver a specific type of product type, flavor, or temperature, such that the contents of the product circuit 133 may be mixed with a diluent from either the first diluent circuit 130 or the second diluent circuit 131 of the beverage dispenser 150.

The fluid lines may further include fittings at each respective end that are complementary to mating components. One of ordinary skill in the art will recognize that fittings commonly utilized in the industry include dole fittings with an o-ring, flare fittings, compression fittings, and the like. Fittings of the removable type may further be secured in place with a suitable restraint.

The beverage dispenser 150 further includes a flow circuit connector 100 having a first member 110, a second member 111, and at least one restraint 102. The first member 110 includes a body 175 having a first aperture 176, a second aperture 177, and a passage 178 therebetween. The first and second apertures 176 and 177 of the body 175 are separated by a predetermined distance complementary to the spacing between the diluent feed aperture 190 and the diluent supply apertures 191 and 192. This spacing is further transferred to the relationship between the inlet 145 of the delivery tube 126 and the outlet 138 of the first diluent line 121, as well as between the inlet 145 of the delivery tube 126 and the outlet 140 of the second diluent line 122.

The first member 110 further includes at least one restraint lock 179 having a restraint passage 180. The restraint locks 179 extend radially from the first and second apertures 176 and 177, such that the restraint passages 180 are wider than the diameter of the first and second apertures 176 and 177. The at least one restraint 102 includes a planar section 182 having a first end 186 and a second end 187. The planar section 182 is of a width complementary to the width of the restraint passage 180 and a tab 183 disposed on the first end 186 of the planar section 182. The planar section 182 further comprises a clearance aperture 184 and a locking aperture 185. In this embodiment, the locking aperture 185 is in communication with the clearance aperture 184 and closer to the first end 186 of the restraint 102. The locking aperture 185 is also of a slightly smaller diameter than the clearance aperture 184, such that a fitting of a fluid line may pass through the clearance aperture 184, but not through the locking aperture 185.

The second member 111 of the flow circuit connector 100 includes a body 205 having a tubing aperture 206 and a restraint lock 207 having a restraint passage 208. The tubing aperture 206 is complementary in diameter to the first and second apertures 176 and 177 of the first member 111, as well as to the diameters of the fittings utilized in the product and diluent flow paths. The restraint lock 207 is substantially identical to the restraint locks 179 of the first member 110, such that the restraints 102 may be utilized with either component.

On assembly, the second end 187 of the at least one restraint 102 is inserted into the restraint passage 180 first member 110 until the clearance aperture 184 is aligned with the respective aperture 176 or 177 of the body 175. Once aligned, the first member 110 may be inserted onto the inlet 145 of the delivery tube 126 and the outlet 138 of the first diluent line 121. Upon full insertion, the restraints 102 may be pushed toward the fitting, such that the reduced diameter of the locking aperture 185 engages a reduced diameter of the fitting. One of ordinary skill in the art will recognize that the fitting disclosed is a dole fitting that further comprises an o-ring for sealing; however, other types of connections may be utilized to provide a removable yet secure connection. Upon the completed connection of the first member 110, the first diluent circuit 130 is in communication with a flow path through the delivery tube 126 that leads to the dispensing valve 118.

Similarly, a restraint 102 may be inserted into the restraint passage 208 of the second member 111 until the clearance aperture 184 is aligned with the tubing aperture 206. Once aligned, the second member 111 of the flow circuit connector 100 may be placed onto the inlet 140 of the second diluent line 122. The restraint 102 may then be similarly engaged in a locked position. Upon securing, the second diluent circuit 131 is capped.

In operation, the first diluent circuit 130, the second diluent circuit 131, and the product circuit 133 are pressurized. A first diluent flows from a diluent source through the first diluent circuit 130, and is chilled in the cold plate 115. The first diluent in the first diluent circuit 130 then moves toward the outlet 138 of the first diluent line 121, and passes through the first member 110 of the flow circuit connector 100 to enter the delivery tube 126. Upon exiting the delivery tube 126, the conditioned diluent enters the dispensing valve 118 for dispensing operations. When a dispense command is received, the conditioned diluent flows through the dispensing valve 118 to enter an operator's cup.

A second diluent flows through the second diluent circuit 131 to be chilled and carbonated as the fluid passes through the cold plate 115. After conditioning, the fluid flows toward the outlet 140 of the second diluent line 122, where the flow is stopped by the second member 111 of the flow circuit connector 100.

In this first embodiment, a product from a product source is forced into the product circuit 133. The product may be conditioned as the product passes through the cold plate 115, and then moves toward the outlet 196 of the product line 124 to enter the product dispensing valve 118. Upon a dispense command, the product flows through the dispensing valve 118 to mix with the exiting diluent stream and land in an operator's cup.

Figure 6:
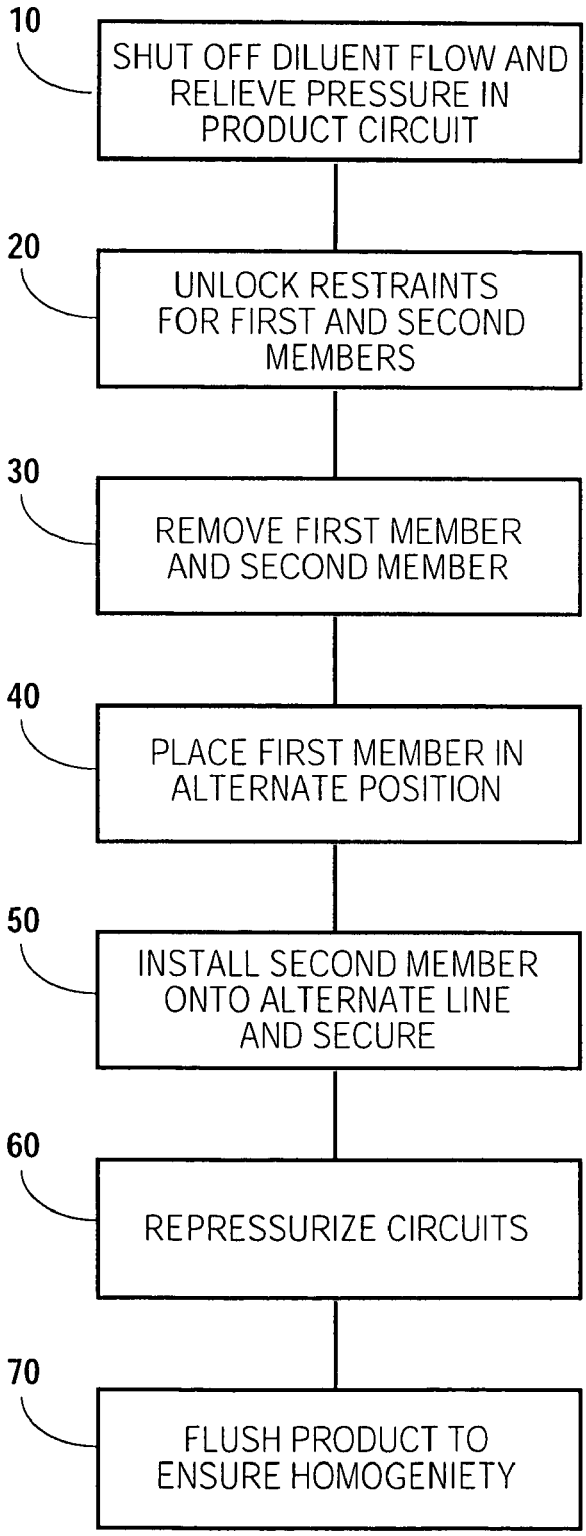
FIG. 6 provides a method for changing a flow path in a beverage dispenser according to the first embodiment.

In use, the flow circuit connector 100 completes the flow path between the first diluent circuit 130 and the dispensing nozzle 118, or between the second diluent circuit 131 and dispensing nozzle 118. The unused flow path may then be capped with the second member 111 of the flow circuit connector 100. The method flowchart of FIG. 6 provides the method steps associated with changing the beverage dispenser 150 from utilizing a first diluent flow circuit 130 to utilizing a second diluent flow circuit 131. As shown in step 10, an operator must shut off the flows of diluent through the beverage dispenser 150, and must also relieve the pressure in the product circuit 133. Upon accessing the first face 158 of the manifold 154, the operator may unlock any restraints 102 that secure the flow circuit connector 100, step 20. Step 30 provides for removing the first and second members 110 and 111 from the fluid lines 126, 121, and 122. Upon removal, both the first and second diluent flow paths 130 and 131 are not continuous to the dispensing valve 118. As shown in step 40, the operator must place the first member 110 in the alternate position, illustratively, over the inlet 145 of the delivery tube 126 and the outlet 140 of the second diluent line 122. The operator may also secure the first member 110 in place with the restraints 102. Step 50 provides for installing the second member 111 onto the outlet 138 of the first diluent line 121, and securing the second member 111 in place. In step 60, the operator may repressurize the diluent lines by turning on the diluent flow and repressurizing the product circuit 133. The operator may then draw a dispense to flush the newly secured flow paths to ensure homogeneity.

The first embodiment provides the capability to switch between a first diluent flow path 130 and a second diluent flow path 131, thereby providing the capability to deliver beverages utilizing a plain diluent or a carbonated diluent. As shown in the method flowchart of FIG. 6, an operator is able to switch a product valve of the beverage dispenser 150 to dispense either carbonated diluent or plain diluent, as well as the reverse. Accordingly, beverage dispensers with a flow circuit connector 100 are increasingly configurable. While this first embodiment has been disclosed with a flow circuit connector 100 having a first member 110 and a second member 111, it should be clear to one of ordinary skill in the art that the flow circuit connector 100 may be formed as a single component that rotates about a central port and the inlet 145 of the delivery tube 126, thereby completing one circuit and capping the unused flow circuit.

While this first embodiment has been disclosed with a beverage dispenser 150 having a cold plate 115, it should be clear to one of ordinary skill in the art that the fluid circuit connector 100 may be utilized with virtually any type of beverage dispenser, ranging from beverage dispensers mechanically cooled through the use of refrigeration systems and cold water baths, to passively refrigerated beverage dispensers utilizing a cold plate to condition a product disposed in a product line.

Figure 7A:
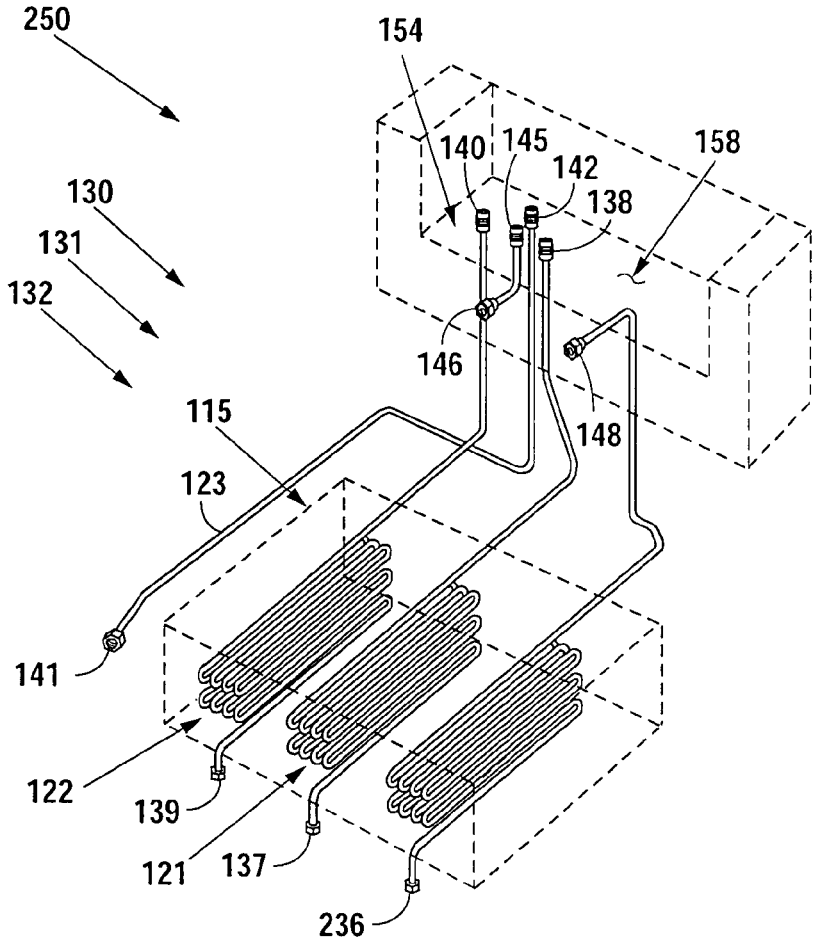
FIG. 7*a* provides a perspective view of components of a beverage dispenser including an ambient diluent flow circuit according to a second embodiment.
Figure 7B:
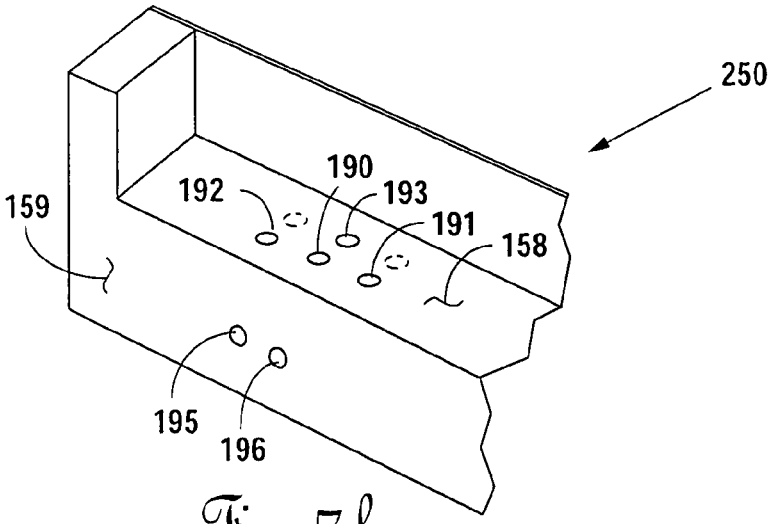
FIG. 7*b* provides a detail view of a manifold according to the second embodiment.
Figure 7C:
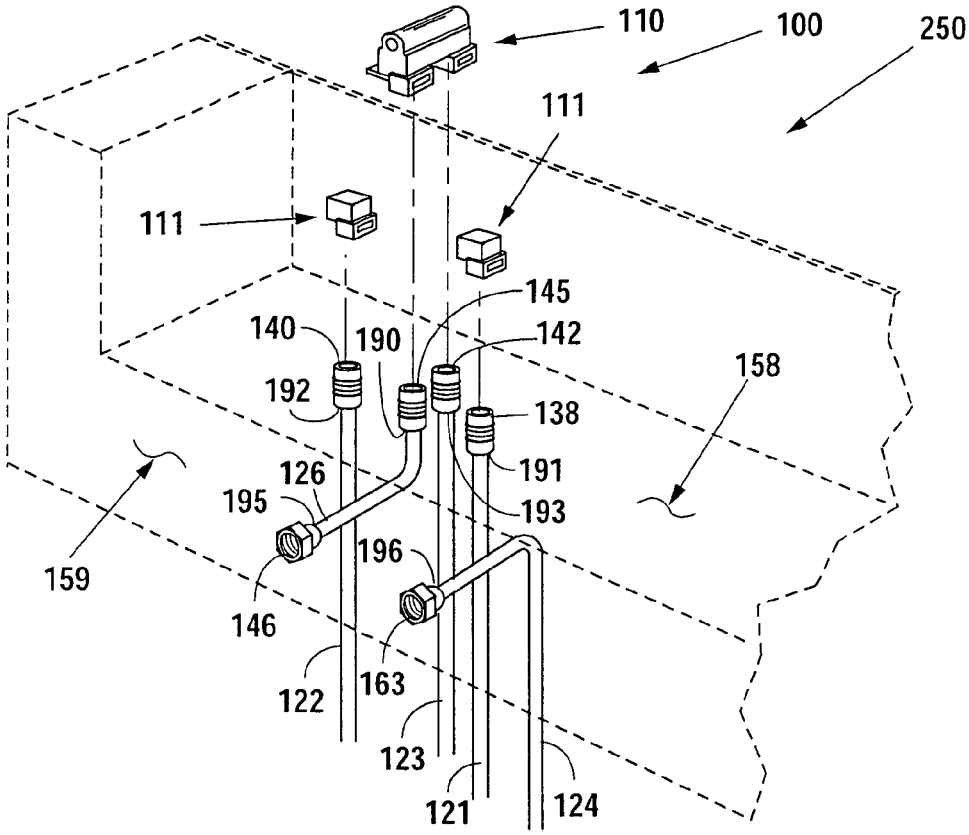
FIG. 7*c* provides a detail view of the flow circuit connector aligned for use in the second embodiment.

In a second embodiment, as illustrated in FIGS. 7*a*-7*c*, a beverage dispenser 250 is identical to the first embodiment in form and function, and accordingly, like parts have been referenced with like numerals. However, the second embodiment further includes a third diluent circuit 132 disposed within the housing 151. The third diluent circuit 132 includes a third diluent line 123 having an inlet 141 and an outlet 142. In this second embodiment, the third diluent circuit 132 may be coupled to the same diluent source as the first embodiment, possibly through a tee connection within the housing 151, such that a single diluent inlet may be utilized. In this second embodiment, the third diluent circuit 132 represents an ambient temperature circuit, and therefore, does not pass through the cold plate 115 for conditioning. The third diluent line 123 may then pass through the housing 110 to gain access to the manifold 154.

In this second embodiment, the first face 158 of the manifold 154 includes a third diluent aperture 193 at a point substantially perpendicular to the collinear diluent apertures 191 and 192, and aligned with the diluent feed aperture 190. The spacing between the third diluent aperture 193 and the diluent feed aperture 190 is complementary to the predetermined distance between the first diluent aperture 191 and the diluent feed aperture 190, such that the first member 110 of the flow circuit connector 100 may be rotated ninety degrees about the inlet 145 of the delivery tube 126 to engage the outlet 142 of the third diluent line 123. The beverage dispenser 250 may further include an additional second member 111 to cap the second exposed circuit.

The operation of the beverage dispenser 250 is substantially identical to the operation of the beverage dispenser 150. However, the beverage dispenser 250 provides three diluent circuits 130, 131, and 132 that are available for use. Each of the circuits must be either completed through attachment to the delivery tube 126 with the first member 110 or capped with one of the second members 111. As such, an operator may select the first diluent circuit 130, the second diluent circuit 131, or the third diluent circuit 132 by rotating the first member 110 about the inlet 145 of the delivery tube 126 and placing the rotated end of the first member 110 onto the outlet 138, 140, or 142 of a particular circuit. Accordingly, the beverage dispenser 250 has the capability to dispense a chilled diluent, a carbonated diluent, and an ambient diluent.

While this second embodiment has been shown with a third diluent circuit 132 accessible at a perpendicular position, one of ordinary skill in the art will recognize that additional diluent circuits beyond the three cited may also be placed at a predetermined spacing consistent with the existing spacing between the diluent feed aperture 190 and the first diluent aperture 191. Accordingly, additional diluent circuits may be located at virtually any angle of rotation of the first member 110 about the inlet 145 of the delivery tube 126, examples of which are shown in FIG. 7*b*. Further the predetermined distance may be elongated or shortened as required as long as the spacing between the apertures 176 and 177 of the first member 110 complements the predetermined distance.

Figure 7D:
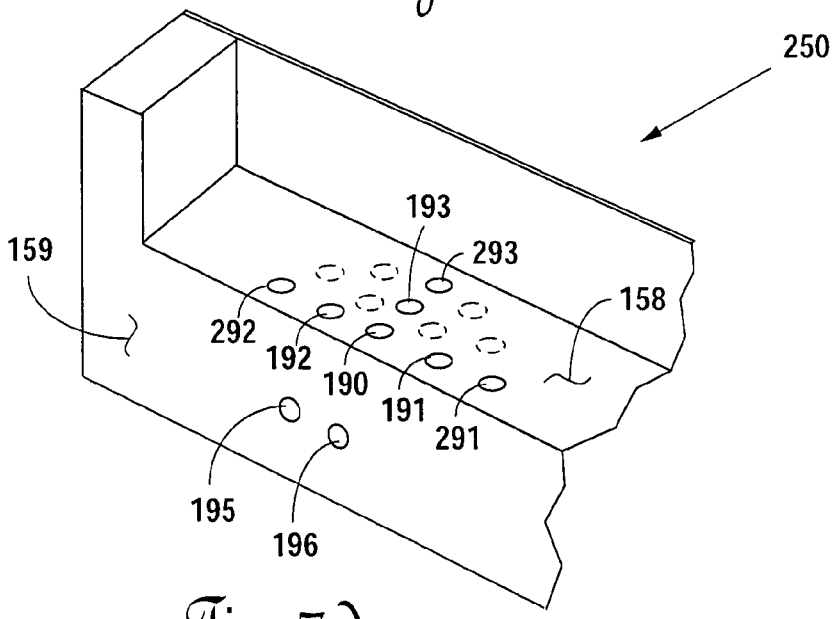
FIG. 7*d* provides a detail view of the manifold with a second bank of diluent apertures.
Figure 7E:
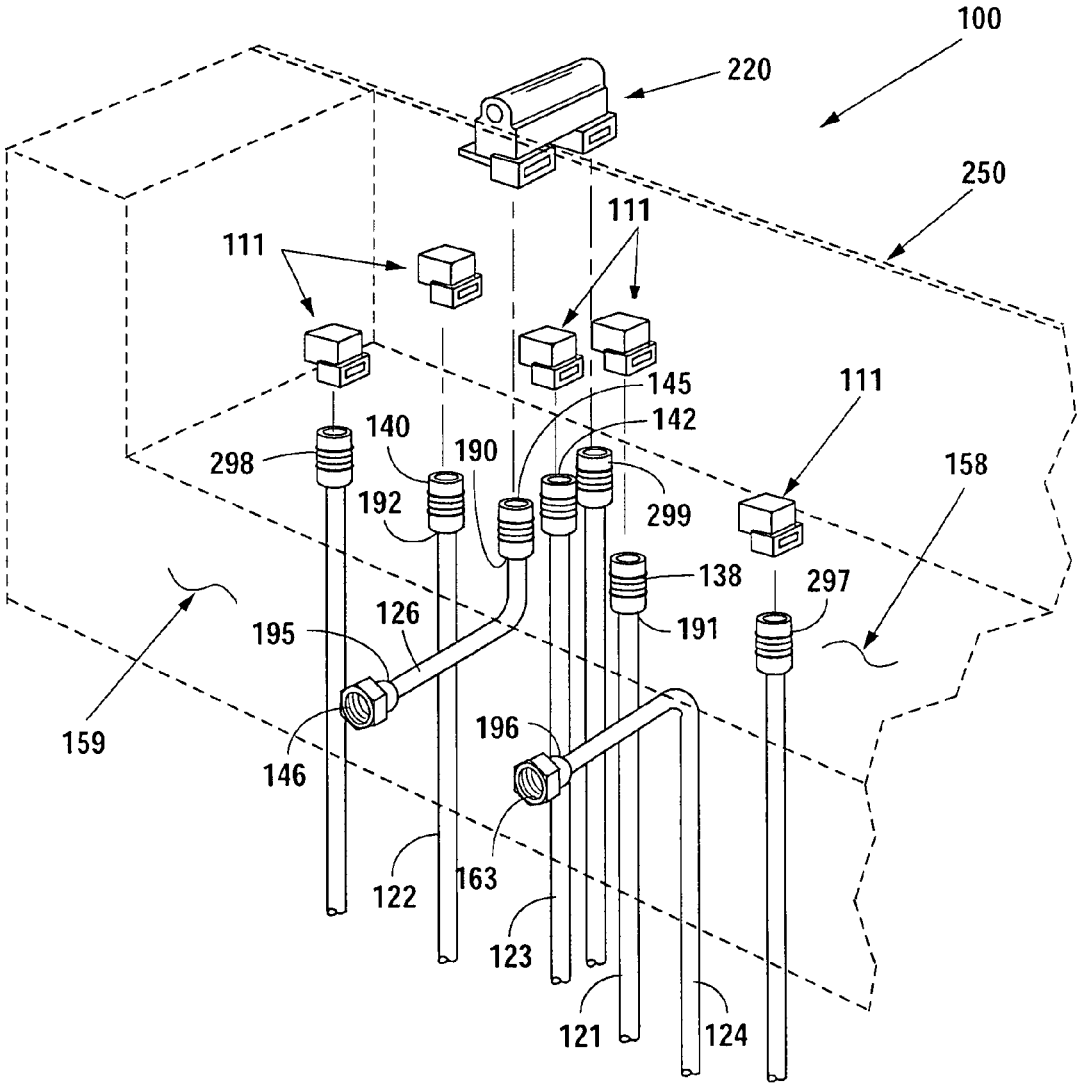
FIG. 7*e* provides a detail view of an elongated first member utilized in conjunction with the second bank of diluent apertures.

One of ordinary skill in the art will further recognize that a second bank of apertures may be located at a second predetermined distance from the inlet 145 to complement a spacing between apertures in an elongated first member 220. As shown in FIG. 7*d*, a second row of apertures may include a second row first diluent aperture 291, a second row second diluent aperture 292, and a second row third diluent aperture 293 disposed at a common distance from the diluent feed aperture 190. The apertures 291, 292, and 293 may further house tubing circuits that may include a second row first outlet 297, a second row second outlet 298, and a second row third outlet 299 as shown in FIG. 7*e*. In this configuration, the elongated first member 220 may couple the inlet 145 and a preselected outlet 297, 298, or 299 to complete a circuit as previously described in the first and second embodiments. All other open circuits would then require capping with a complementary number of second members 111. Accordingly, a beverage dispenser could house a bank of outlets at consistent radius, and further banks at increasing radii that may be complementary to a predetermined spacing of a first member 110, as well as any required elongated first members consistent with a spacing consistent with the outer banks.

Figure 8A:
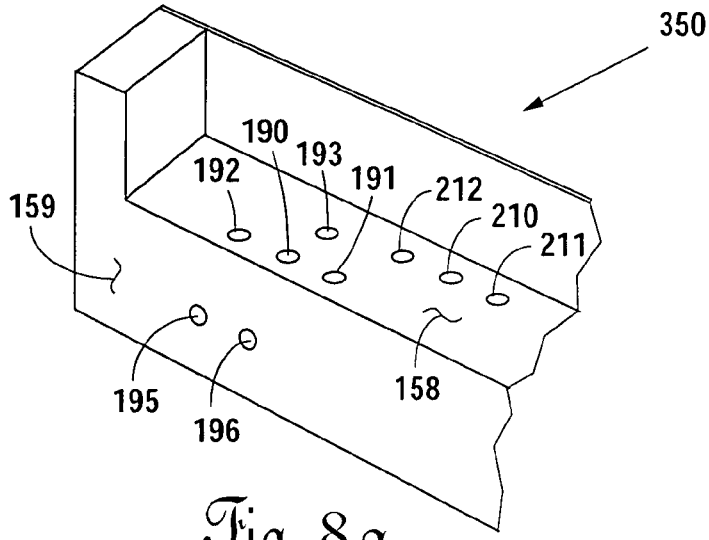
FIG. 8*a* provides a detail view of the manifold according to a third embodiment.
Figure 8B:
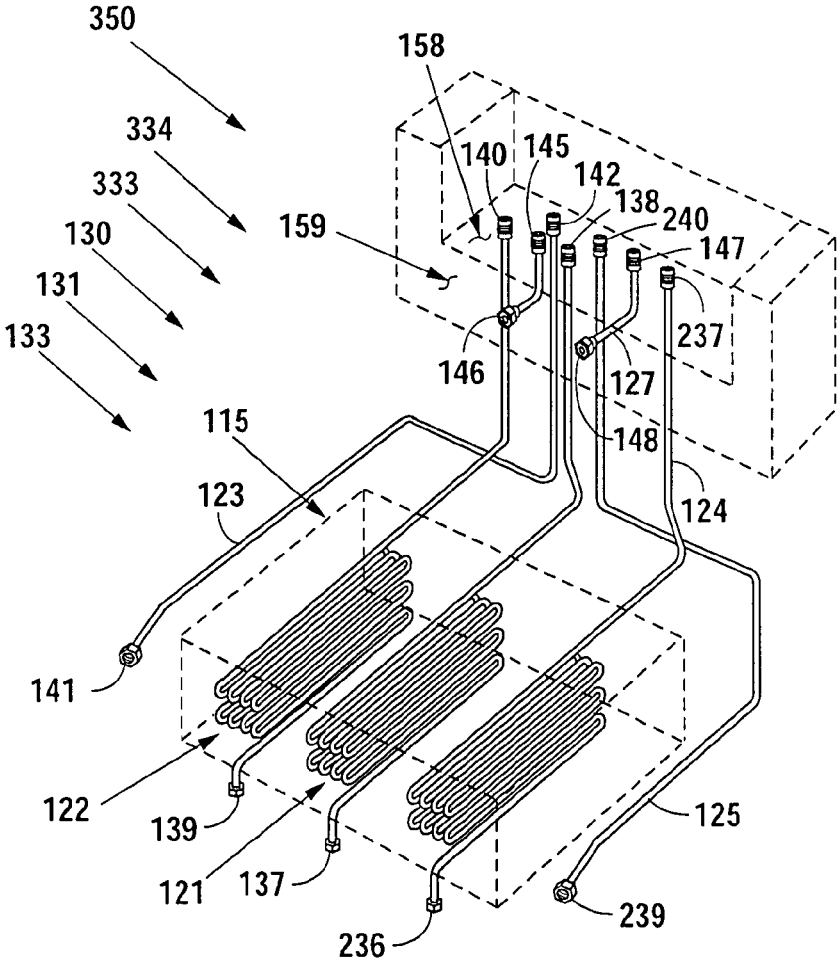
FIG. 8*b* provides a perspective view of components of a beverage dispenser including a first and second product circuit according to the third embodiment.
Figure 8C:
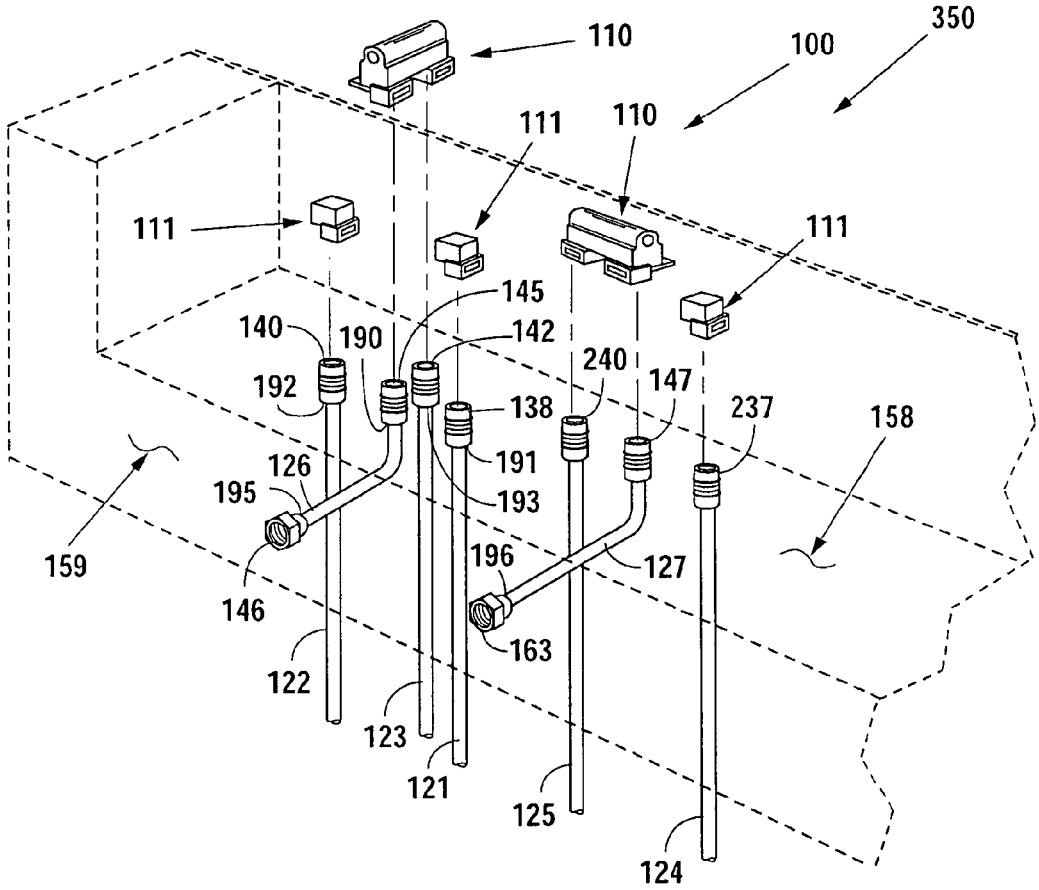
FIG. 8*c* provides a detail view of the flow circuit connector aligned for use in the third embodiment.

In a third embodiment, as illustrated in FIGS. 8*a*-8*c*, a beverage dispenser 350 is substantially identical in form and function to the first and second embodiments, and accordingly, like parts have been referenced with like numerals. In this third embodiment, the first face 158 of the manifold 154 further includes a product feed aperture 210, a first product aperture 211, and a second product aperture 212. The apertures 210, 211 and 212 are disposed collinearly in similar fashion to the diluent apertures 191, 192, and 190, however, the product apertures 210, 211, and 212 may be further from the second face 159 of the manifold 154 as required for clearance. The beverage dispenser 350 further includes at least two product circuits disposed within the housing 151. Accordingly, the product circuit 133 of the first embodiment may be replaced with a first product circuit 333 and a second product circuit 334. The first product circuit 333 provides a chilled or conditioned flow path through the housing 151, and includes a first product line 124 having an inlet 236 and an outlet 237. The inlet 236 is disposed near a front of the beverage dispenser 350. The first product line 124 passes through the cold plate 115 for conditioning, exits a rear portion of the cold plate 115, and proceeds upward to the manifold 154. The outlet 237 of the first product line 124 passes through the manifold 154 at the first product aperture 211.

The second product circuit 334 represents an ambient product circuit and therefore, does not include conditioning by the cold plate 115. The second product circuit 334 may include a second product line 125 having an inlet 239 and an outlet 240. The inlet 239 of the second product line 125 may be disposed near the front of the beverage dispenser 350 for ease of connection. The second product line 125 passes through the housing 151 to gain entrance to the manifold 154, and passes through the manifold 154 at the second product aperture 212. The beverage dispenser 350 further includes a second delivery tube 127 having an inlet 147 and an outlet 148. The inlet 147 of the delivery tube 127 is disposed at the product feed aperture 210, and the outlet 148 is disposed at the product delivery aperture 196.

The beverage dispenser 350 further includes an additional flow circuit connector 100 to complete or cap the flow paths of the first and second product circuits 333 or 334. In this third embodiment, the first member 110 of the flow circuit connector 100 is disposed on the inlet 147 of the second delivery tube 127, and the outlet 240 of the second product line 125 such that the second product flow path 334 may continue through the second delivery tube 127 to supply the dispensing valve 118. Similarly, the first member 110 of the flow circuit connector 100 disposed on the diluent circuit connects the outlet 142 of the third diluent line 123 and the inlet 145 of the delivery tube 126. All open flow paths are then shut off with a second member 111 of the flow circuit connector 100.

In this configuration, the beverage dispenser 350 may dispense a beverage through the second product circuit 334 and the third diluent circuit 132 to provide an ambient temperature dispense. While this beverage dispenser 350 has been shown with a second product circuit 334, one of ordinary skill in the art will recognize that additional flow circuits may be placed at virtually any angle of rotation about the inlet 147 of the second delivery tube 127, thereby offering further combinations of beverage types and associated flow paths, including full carbonation flow paths, partial carbonation flow paths, and different flavor flow paths.

Operation of the beverage dispenser 350 is substantially identical to the operation of the beverage dispensers 150 and 250. However, the beverage dispenser 350 provides three diluent circuits 130, 131, and 132 that are available for use, and at least two product circuits 333 and 334. Each of the circuits must be either completed through attachment to one of the delivery tubes 126 or 127 with one of the first members 110, or capped with one of the second members 111. As such, an operator may select to utilize the first diluent circuit 130, the second diluent circuit 131, or the third diluent circuit 132 by rotating the first member 110 about the inlet 145 of the first delivery tube 126 and placing the rotated end of the first member 110 onto the outlet 138, 140, or 142 of a particular circuit. The operator may further select to utilize the first product circuit 333 or the second product circuit 334 by rotating the first member 110 about the inlet 147 of the second delivery tube 127 and placing the rotating end of the first member 110 onto the outlet 237 or 240. Accordingly, the beverage dispenser 350 may have the capability to dispense a chilled diluent, a carbonated diluent, an ambient diluent, a chilled product, an ambient product, or any combination of diluent and product thereof.

While this third embodiment has been shown with a second product circuit 334 accessible at a symmetrical position, one of ordinary skill in the art will recognize that additional product circuits beyond those cited may be placed at a spacing consistent with the existing spacing between the inlet 147 of the delivery tube and the outlet 237 of the first product circuit 333. One of ordinary skill in the art will further recognize that virtually any angle of rotation of the first member 110 about the inlet 147 of the second delivery tube 127 may be utilized to locate additional product circuit lines. One of ordinary skill in the art will further recognize that additional banks of apertures and outlets may be placed about the inlets 145 and 147 of the first and second valve delivery tubes 126 and 127 to be utilized with an elongated first member as previously disclosed. Accordingly, the beverage dispenser 350 may house a multitude of additional diluent and product circuits in multiple banks, wherein a first member 110 or an elongated first member having a spacing consistent with a bank radii may be utilized to couple an outlet with the inlet 145 or 147 to complete a particular product or diluent circuit. Once each inlet is coupled to a preselected outlet, the remaining outlets surrounding the inlet 145 or 147 may be capped utilizing a second member 111 for each exposed outlet.

Although the present invention has been described in terms of the foregoing preferred embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing detailed description; rather, it is defined only by the claims that follow.

We claim:

1. A beverage dispenser, comprising:

a manifold accessible by an operator;

a delivery tube disposed partially within the manifold, the delivery tube including an inlet located exterior to the manifold and an outlet located exterior to the manifold that communicates with a beverage dispensing valve;

a first flow circuit disposed partially within the manifold, the first flow circuit including an outlet located exterior to the manifold a predetermined distance from the inlet of the delivery tube, whereby the first flow circuit flows a first diluent to the outlet;

a second flow circuit disposed partially within the manifold, the second flow circuit including an outlet located exterior to the manifold a predetermined distance from the inlet of the delivery tube, whereby the second flow circuit flows a second diluent to the outlet; and a flow circuit connector, comprising:

a first member including a first port and a second port and a passage therebetween, wherein the first port is connectable directly with and removable from the inlet of the delivery tube and the second port is connectable directly with and removable from one of the outlet of the first flow circuit and the outlet of second flow circuit, further wherein removing the second port from the outlet of the second flow circuit and directly connecting the second port with the outlet of the first flow circuit extends the first flow circuit through the delivery tube to the beverage dispensing valve for delivery of the first diluent, still further wherein removing the second port from the outlet of the first flow circuit and directly connecting the second port with the outlet of the second flow circuit extends the second flow circuit through the delivery tube to the beverage dispensing valve for delivery of the second diluent, and a second member directly connectable with and removable from one of the outlet of the first flow circuit and the outlet of the second flow circuit, wherein, when the second port is connected directly with the outlet of the first flow circuit, the second member is removed from the outlet of the first flow circuit and directly connected with the outlet of the second flow circuit to stop the flow of the second diluent from the second flow circuit, further wherein, when the second port is connected directly with the outlet of the second flow circuit, the second member is removed from the outlet of the second flow circuit and directly connected with the outlet of the first flow circuit to stop the flow of the first diluent from the first flow circuit.

2. The beverage dispenser according to claim 1, wherein:

the first member of the flow circuit connector is rotatable about the inlet of the delivery tube for connecting the second port with one of the outlet of the first flow circuit and the outlet of the second flow circuit.

3. The beverage dispenser according to claim 1, further comprising:

a product circuit containing a product in communication with the beverage dispensing valve, wherein the product is delivered to the beverage dispensing valve for mixing with the first diluent delivered to the beverage dispensing valve.

4. The beverage dispenser according to claim 1, further comprising:

a product circuit containing a product in communication with the beverage dispensing valve, wherein the product is delivered to the beverage dispensing valve for mixing with the second diluent delivered to the beverage dispensing valve.

5. The beverage dispenser according to claim 1, further comprising:

a third flow circuit flowing a third diluent to an outlet therefrom, wherein the outlet is located exterior to the manifold a predetermined distance from the inlet of the delivery tube; and an additional second member, wherein the first member of the flow circuit connector rotates about the inlet of the delivery tube and directly connects with the outlet of the third flow circuit to extend the third flow circuit to the beverage dispensing valve, further wherein, the second members of the flow connector directly connect with one of the outlets of the first and second flow circuits to stop the flows of the first and second diluents from the first and second flow circuits.

6. The beverage dispenser according to claim 5, further comprising:

a product circuit containing a product in communication with the beverage dispensing valve, wherein the product is delivered to the beverage dispensing valve for mixing with the third diluent delivered to the beverage dispensing valve.

7. The beverage dispenser according to claim 5, wherein the outlet of the third flow circuit may be located at virtually any angle about the inlet of the delivery tube.

8. The beverage dispenser according to claim 6, further comprising:

a second bank of flow circuit outlets located exterior to the manifold and disposed at a second predetermined distance from the inlet of the delivery tube;

an elongated first member including a first port and a second port and a passage therebetween, wherein the first port is connected directly with the inlet of the delivery tube and the second port is connected directly with an outlet disposed on the second bank, thereby extending the selected flow circuit through the delivery tube to the beverage dispensing valve for the delivery of a diluent; and a second member directly connected to each unselected outlet on the second bank to stop the flow of diluents from the unselected outlets.

9. The beverage dispenser according to claim 8, wherein the outlets of the second bank may be located at virtually any angle about the inlet of the delivery tube.

10. The beverage dispenser according to claim 1, further comprising:

a second delivery tube disposed partially within the manifold, the delivery tube including an inlet located exterior to the manifold and an outlet located exterior to the manifold that communicates with a beverage dispensing valve;

a first product circuit providing a flow of a first product from an outlet;

a second product circuit providing a flow of a second product from an outlet; and a second flow circuit connector, wherein a first port of a first member directly connects with the inlet of the second delivery tube and a second port directly connects with the outlet of the first product circuit, thereby extending the first product circuit through the second delivery tube to the beverage dispensing valve, further wherein, a second member of the second flow circuit connector directly connects with the outlet of the second product circuit to stop the flow of the second product from the second product circuit.

11. The beverage dispenser according to claim 10, wherein the first member of the first flow circuit connector rotates about the inlet of the first delivery tube and directly connects with the outlet of the second flow circuit, thereby extending the second flow circuit to the beverage dispensing valve, further wherein, the second member of the first flow circuit connector directly connects with outlet from the first flow circuit to stop the flow of the first diluent, thereby delivering the first product and the second diluent to the beverage dispensing valve.

12. The beverage dispenser according to claim 10, wherein the first member of the second flow circuit connector rotates about the inlet of the second delivery tube and directly connects with the outlet of the second product circuit, thereby extending the second product circuit to the beverage dispensing valve, further wherein, the second member of the second flow circuit connector directly connects with the outlet of the first product circuit to stop the flow of the first product from the first product circuit.

13. The beverage dispenser according to claim 12, wherein the first member of the first flow circuit connector rotates about the inlet of the first delivery tube and directly connects with the outlet of the second flow circuit, thereby extending the second flow circuit to the beverage dispensing valve, further wherein, the second members of the first flow circuit connector directly connects with the outlet from the first flow circuit to stop the flow of the first diluent, thereby delivering the second product and the second diluent to the beverage dispensing valve.

14. The beverage dispenser according to claim 12, further comprising:

a third flow circuit flowing a third diluent to an outlet therefrom, wherein the outlet is located exterior to the manifold a predetermined distance from the inlet of the delivery tube; and an additional second member, wherein the first member of the first flow circuit connector rotates about the inlet of the first delivery tube and directly connects with the outlet of the third flow circuit, thereby extending the third flow circuit to the beverage dispensing valve, further wherein, the second members of the first flow circuit connector directly connect with outlets from the first flow circuit and the second flow circuits to stop the flow of the first diluent and the second diluent, thereby delivering the second product and the third diluent to the beverage dispensing valve.

15. The beverage dispenser according to claim 14, wherein the outlets of the product circuits may be disposed at any angle of rotation about the inlet of the delivery tube.

16. The beverage dispenser according to claim 14, further comprising:

a second bank of flow circuit outlets disposed located exterior to the manifold and at a second predetermined distance from the inlet of the delivery tube;

an elongated first member including a first port and a second port and a passage therebetween, wherein the first port is connected directly with the inlet of the delivery tube and the second port is connected directly with an outlet disposed on the second bank, thereby extending the selected flow circuit through the delivery tube to the beverage dispensing valve for the delivery of a product; and a second member directly connected to each unselected outlet on the second bank to stop the flow of products from the unselected outlets.

17. The beverage dispenser according to claim 16, wherein the outlets of the second bank may be located at virtually any angle about the inlet of the delivery tube such that the elongated first member may align with any outlet by rotating about the inlet of the delivery tube.

18. The beverage dispenser according to claim 1, wherein the first diluent flow path is conditioned to deliver a chilled diluent.

19. The beverage dispenser according to claim 1, wherein the second diluent flow path is conditioned to deliver a chilled and carbonated diluent.

20. The beverage dispenser according to claim 5, wherein the third diluent flow path is not conditioned, thereby delivering an ambient diluent.

21. The beverage dispenser according to claim 10, wherein the first product circuit delivers a conditioned product.

22. The beverage dispenser according to claim 21, wherein the conditioned product is chilled.

23. The beverage dispenser according to claim 10, wherein the second product circuit delivers an ambient product.

24. The beverage dispenser according to claim 1, wherein the first and second members of the flow circuit connector are joined to create a single unit that may be rotated about the inlet of the delivery tube.

* * * * *